US008991122B2

(12) United States Patent
Abbey

(10) Patent No.: US 8,991,122 B2
(45) Date of Patent: Mar. 31, 2015

(54) PRECAST LIGHT POLE FOUNDATION

(76) Inventor: Jay Abbey, Binghamton, NY (US)

( * ) Notice: Subject to any disclaimer, the term of this patent is extended or adjusted under 35 U.S.C. 154(b) by 113 days.

(21) Appl. No.: 13/523,937

(22) Filed: Jun. 15, 2012

(65) Prior Publication Data

US 2015/0027073 A1 Jan. 29, 2015

(51) Int. Cl.

| | |
|---|---|
| ***E02D 27/00*** | (2006.01) |
| ***E02D 27/32*** | (2006.01) |
| ***E02D 27/42*** | (2006.01) |
| ***E04H 12/34*** | (2006.01) |
| ***E04H 12/22*** | (2006.01) |

(52) U.S. Cl.

CPC ..... *E02D 27/42* (2013.01); *E04H 12/347* (2013.01); *E04H 12/2253* (2013.01)

USPC ..... 52/296; 52/125.5; 52/169.13

(58) Field of Classification Search

CPC ..... E04D 27/00; E04D 27/016; E04D 27/32; E04D 27/42; E04D 27/48; E04D 27/50; E04H 12/00; E04H 12/22; E04H 12/2238; E04H 12/2253; E04H 12/2261; E04H 12/2269; E04H 12/2276; E04H 12/347; E04C 3/30; E04C 3/34; E04B 1/4114; E04B 1/4135; E04G 21/142

USPC ..... 52/40, 98, 122.1, 124.2, 125.1–125.5, 52/126.1, 169.1, 169.9, 169.13, 253, 259, 52/283, 292, 294, 295, 296, 297, 52/FOR. 119, FOR. 152

See application file for complete search history.

(56) References Cited

U.S. PATENT DOCUMENTS

| | | | | |
|---|---|---|---|---|
| 2,374,624 | A * | 4/1945 | Schwendt | 52/223.5 |
| 3,630,474 | A * | 12/1971 | Minor | 52/98 |
| 3,988,870 | A * | 11/1976 | Snavely | 52/296 |
| 4,674,907 | A * | 6/1987 | Shewchuk | 403/2 |
| 4,878,160 | A | 10/1989 | Reneau et al. | |
| 5,400,997 | A * | 3/1995 | Payne et al. | 248/523 |
| 5,548,939 | A * | 8/1996 | Carmical | 52/707 |
| 5,564,235 | A | 10/1996 | Butler | |
| 5,746,036 | A * | 5/1998 | Angelette | 52/295 |
| 5,966,882 | A * | 10/1999 | Naito | 52/295 |
| 6,167,673 | B1 * | 1/2001 | Fournier | 52/848 |
| 6,851,231 | B2 | 2/2005 | Tadros et al. | |
| 6,873,303 | B2 | 3/2005 | Creighton et al. | |
| 6,938,392 | B2 | 9/2005 | Fouad et al. | |
| 7,004,043 | B2 | 2/2006 | Erel et al. | |
| RE40,228 | E | 4/2008 | Savoca | |
| 7,654,057 | B2 * | 2/2010 | Zambelli et al. | 52/710 |
| 7,779,588 | B1 * | 8/2010 | Bruning | 52/297 |
| 7,827,748 | B2 * | 11/2010 | Brown | 52/295 |

(Continued)

OTHER PUBLICATIONS

Kistner Concrete Products, Inc., K Precast Light Bases Tapered—Square—Round, Specification Sheet Rev. 2-11-03, 2003, 1 page.

*Primary Examiner* — Joshua J Michener
*Assistant Examiner* — Theodore Adamos
(74) *Attorney, Agent, or Firm* — Krenz Patent Law, LLC

(57) ABSTRACT

A precast pole foundation having an elongated concrete body having an upper surface and a lower surface. At least two parallel concrete bolts extend from the upper surface of the concrete body. At least one cavity is disposed along the body of the concrete body for receiving a conduit. The pole foundation is preferably cylindrical and can be used to support a light pole, a utility pole, a sign pole of any such structure. At least a portion of the concrete body is reinforced with at least one reinforcing bar embedded therein.

14 Claims, 4 Drawing Sheets

(56) References Cited

U.S. PATENT DOCUMENTS

| | | | | |
|---|---|---|---|---|
| 8,037,646 | B2 * | 10/2011 | Wobben | 52/126.3 |
| 2003/0208969 | A1 * | 11/2003 | Lancelot et al. | 52/125.4 |
| 2004/0010984 | A1 * | 1/2004 | Wright | 52/125.4 |
| 2005/0120644 | A1 | 6/2005 | Taros et al. | |
| 2007/0039281 | A1 * | 2/2007 | Zambelli et al. | 52/710 |
| 2009/0040750 | A1 * | 2/2009 | Myer | 362/183 |
| 2013/0036678 | A1 * | 2/2013 | Nyce et al. | 52/105 |
| 2013/0036679 | A1 * | 2/2013 | Nyce et al. | 52/105 |

* cited by examiner

PRECAST LIGHT POLE FOUNDATION

FIELD OF THE INVENTION

The present invention pertains to precast concrete foundations and, more particularly, to a precast concrete foundation for a light pole.

BACKGROUND OF THE INVENTION

Light poles and utility poles for use at outdoor locations must be strong enough to withstand external forces including but not limited to human and machine impacts and forces of nature up to and including wind and snow and ice storms, hurricanes, and even tornadoes.

It is not unusual, therefore, for property owners to install such poles by excavating ground and then pouring concrete into the base thereof prior or after placement of the pole structure. Such procedures are especially labor intensive, even with the aid of earth-moving or construction machines. Due to the nature of concrete pouring and the unpredictability of ground and atmosphere conditions, it is also difficult to know the effect of such projects in advance.

Precast concrete structures have been developed, but all have drawbacks, especially in their inability to adjust for anchor bolt patterns having varying sizes and diameters. Concrete and stone anchors, as well as precast concrete structures, are manufactured by Halfen Gmbh & Co., KG, Langenfield, Germany, among other companies.

Moreover, conventional structures and products fail to accommodate various size conduits and conduit configurations.

DISCUSSION OF THE RELATED ART

United States Published Patent Publication No. 2005/0120644 on application of Taros, et al. published on Jun. 9, 2005, and U.S. Pat. No. 6,851,231 issued to Tadros, et al. on Feb. 8, 2005 for PRECAST POST-TENSIONED SEGMENTAL POLE SYSTEM disclose a precast post-tensioned segmental pole system capable of supporting a load. The pole system includes a plurality of pole segments that use connectors and strands to anchor them together. The strands extend within a cavity formed in the pole segments and are external to the wall structure of the pole segments. The strands may be coupled between both of the pole segments, or be anchored to a connector. The connector includes an upper piece that is coupled to one pole segment, and a lower piece that is coupled to the other pole segment. Upper and lower pieces interlock with each other to join the pole segments to one another. The strands are placed in tension so that pole system is capable of withstanding forces imposed by the load.

U.S. Pat. No. 6,873,303, issued to Creighton et al. on Mar. 29, 2005 for TELECOMMUNICATIONS MAST INSTALLATION, discloses a telecommunications mast installation, typically a base station in a cellular telephone network, which includes a mast supporting a telecommunications antenna. A foundation structure supports the mast. The foundation structure is in the form of an enclosed chamber situated at least partially underground and defining an internal space which is accessible to personnel and which accommodates electronic equipment associated with operation of the antenna. For aesthetic and security reasons, it is preferred that the chamber be completely underground.

None of these patents or published patent application, individually or in any combination, is seen to teach or suggest the precast pole foundation of the present invention.

SUMMARY OF THE INVENTION

The present invention is a precast pole foundation having an elongated concrete body having an upper surface and a lower surface. At least two parallel concrete bolts extend from the upper surface of the concrete body. At least one cavity is disposed along the body of the concrete body for receiving a conduit. The pole foundation is preferably cylindrical and can be used to support a light pole, a utility pole, a sign pole of any such structure. At least a portion of the concrete body is reinforced with at least one reinforcing bar embedded therein.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

In accordance with the present invention, there is disclosed a precast pole foundation having an elongated concrete body. At least two parallel concrete bolts extend from the upper surface of the concrete body. At least one cavity is disposed along the body of the concrete body for receiving a conduit. The pole foundation is preferably cylindrical and can be used to support a light pole, a utility pole, a sign pole of any such structure.

Figure 1:
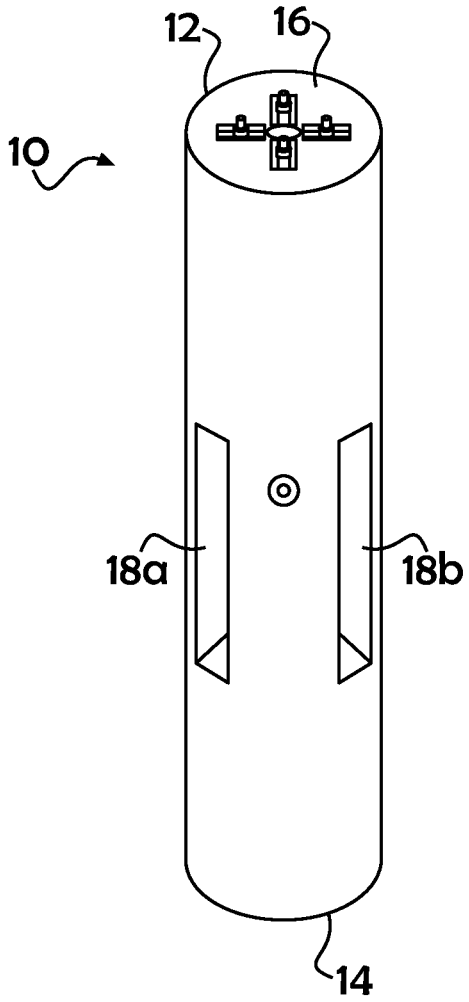
FIG. 1 is a perspective view of the precast concrete pole foundation in accordance with the present invention.

Referring now to FIG. 1, there is shown a perspective view of the precast concrete pole foundation 10. In the preferred embodiment, foundation 10 is cylindrically shaped with a diameter of 24", although any reasonable diameter can be used. Foundation 10 and has an upper surface 12 and a lower surface 14. For precasting material, concrete is preferred due to its strength and relative ease of forming and handling.

Embedded in upper surface 12 of foundation 10 is a bolt circle 16, described in further detail hereinbelow.

Two cavities 18*a*, 18*b* are formed in the body of foundation proximate a midpoint thereof, as shown. These two cavities can receive one or more conduits, not shown, of varying shapes and dimensions. The cavities 18*a*, 18*b* are known in the trade as conduit block outs.

Figure 2:
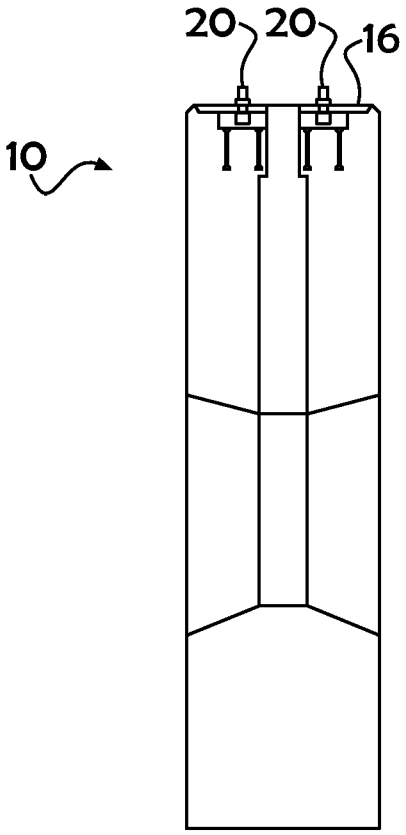
FIG. 2 is a cross-sectional view of the pole foundation shown in FIG. 1.

Referring now also to FIG. 2, there is shown a cross-sectional view of pole foundation 10. Extending from bolt circle 16 are parallel spaced apart concrete bolts 20 preferably constructed of steel. Any number of bolts 20 can be provided, the minimal number being two. Bolts 20 are offset or spaced apart from each other a predetermined distance, as required by the pole, not shown, that foundation 10 is to support. Conventional spacing of bolts 20 is 5½" or 1'-3", although any reasonable dimension can be used. Extending downwardly and embedded into concrete foundation 10 from bolt circle 16 are 6" steel anchors, such a manufactured and sold by Halfen Gmbh & Co.

Figure 3A:
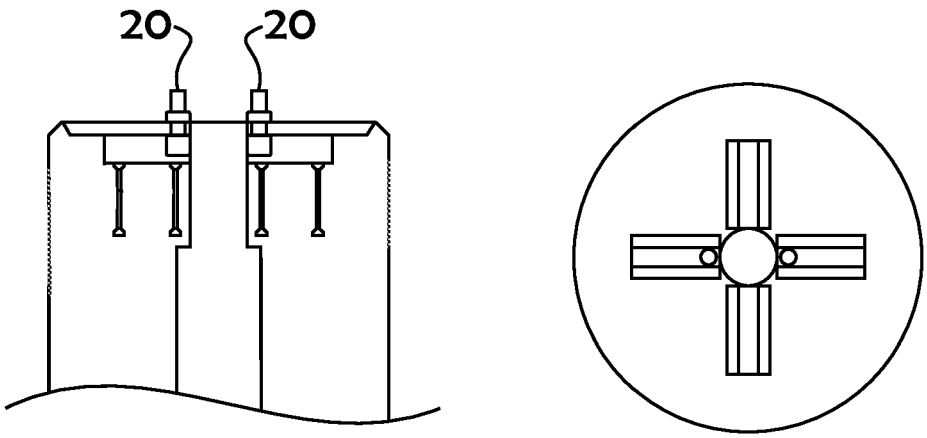
FIG. 3*a* is a top plan view of the upper surface of the pole foundation showing placement of two of the concrete bolts a first distance apart.
Figure 3B:
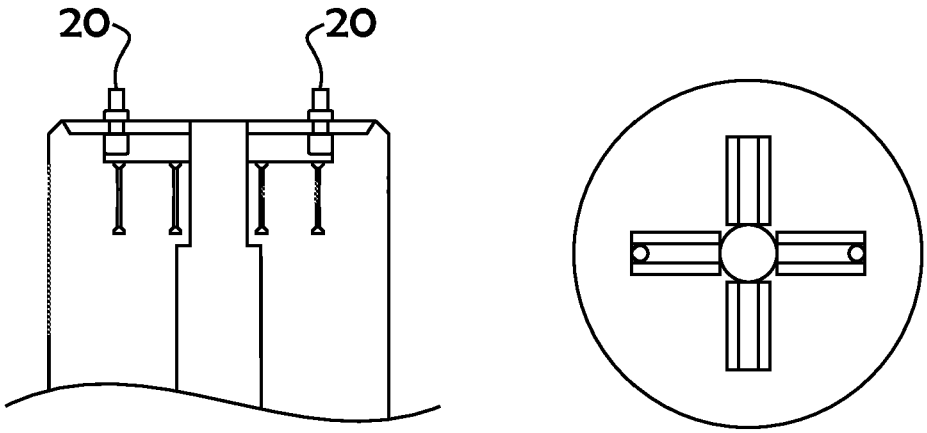
FIG. 3*b* is a top plan view of the upper surface of the pole foundation showing placement of two of the concrete bolts a second distance apart.

Referring now to FIGS. 3*a* and 3*b*, top plan views of the upper surface of pole foundation 10 are shown, indicating placement of two concrete bolts 20. FIG. 3*a* shows the distance between bolts 20 being approximately 5½", whereas FIG. 3*b* shows the distance between bolts 20 being approximately 1'-3". Any custom dimensions can be ordered and provided to contractors between and including these two shown dimensions.

Figure 4:
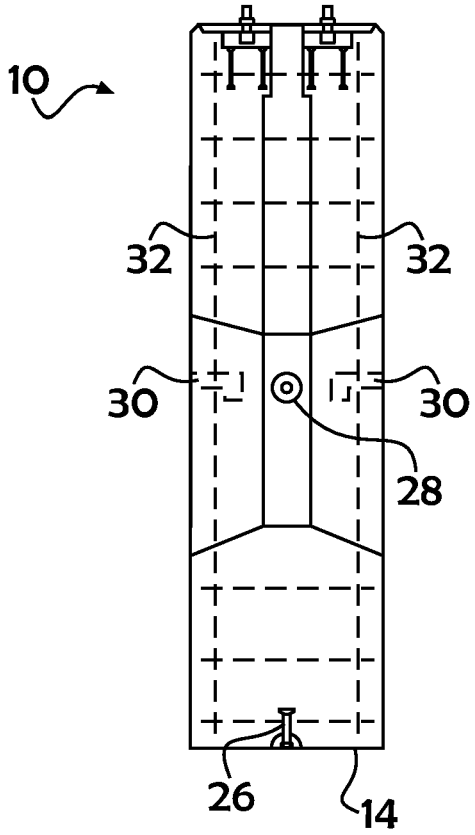
FIG. 4 is a cross-sectional view of the pole foundation showing a tee bolt affixed to the lower surface thereof.

Referring now to FIG. 4, there is shown is a cross-sectional view of pole foundation 10 showing an optional tee bolt 26 affixed to the lower surface 14 thereof. Tee bolt 26 is also manufactured by Halfen Gmbh & Co. as Model Nos. M20 or M24.

Disposed at a central part of the body of foundation 10 is a 4-ton swift lift anchor 28 with two corresponding, oppositely-disposed keylock lifters 30 placed proximate thereto for lifting foundation 10 when desired.

Also optionally embedded in the body of foundation 10 is at least one reinforcing bar (rebar) 32. A no. 6 rebar is preferred for the dimensions of foundation 10 herein disclosed.

Since other modifications and changes varied to fit particular operating requirements and environments will be apparent to those skilled in the art, this invention is not considered limited to the example chosen for purposes of this disclosure, and covers all changes and modifications which does not constitute departures from the true spirit and scope of this invention.

Having thus described the invention, what is desired to be protected by Letters Patent is presented in the subsequently appended claims.

What is claimed is:

1. A precast pole foundation comprising:

an elongated concrete body that includes an upper surface and a lower surface, the upper surface defining an opening in the upper surface that extends downward into the elongated concrete body;

a first anchor and a second anchor, each embedded within the elongated concrete body at the upper surface, each positioned about the opening, and each extending radially along the upper surface, wherein the first anchor is positioned across the opening from the second anchor, and wherein a first end of the first anchor is positioned near the opening and a second end of the first anchor, opposite the first end, is bounded by a portion of the concrete body; and a first bolt that extends from the first anchor and a second bolt that extends from the second anchor, wherein the first and second anchors are configured for adjusting a distance between the first bolt and the second bolt, and wherein the first bolt and the second bolt are spaced apart a predetermined distance from one another and extending from said upper surface of said concrete body;

wherein, when in use and prior to the first bolt and the second bolt being spaced apart the predetermined distance from one another, a portion of the first bolt is inserted into the first anchor and is free to move radially within the first anchor, the portion of the first bolt being blocked from removal from the first anchor at the second end of the first anchor by the portion of the concrete body.

2. The precast pole foundation in accordance with claim 1, further comprising at least one cavity disposed along said concrete body proximate a midpoint thereof for receiving a conduit.

3. The precast pole foundation in accordance with claim 1, further comprising at least one tee bolt proximate said lower surface of said concrete body.

4. The precast pole foundation in accordance with claim 1, wherein said elongated concrete body comprises a cylinder.

5. The precast pole foundation in accordance with claim 1, wherein said pole comprises at least one of the group: light pole, utility pole, and sign pole.

6. The precast pole foundation in accordance with claim 1, wherein the first anchor and the second anchor are configured to guide the first bolt and the second bolt, respectively.

7. The precast pole foundation in accordance with claim 1, wherein at least a portion of said concrete body is reinforced with at least one reinforcing bar embedded therein.

8. A precast pole foundation comprising:

an elongated concrete body that includes an upper surface and a lower surface, the upper surface defining an opening in the upper surface that extends downward into the elongated concrete body;

a first anchor, a second anchor, a third anchor, and a fourth anchor, each embedded within the elongated concrete body at the upper surface, each positioned about the opening, and each extending radially along the upper surface, wherein the first anchor is positioned across the opening from the second anchor, wherein the third anchor is positioned across the opening from the fourth anchor, and wherein a first end of the first anchor is positioned near the opening and a second end of the first anchor, opposite the first end, is bounded by a portion of the concrete body; and a first bolt that extends from the first anchor, a second bolt that extends from the second anchor, a third bolt that extends from the third anchor, and a fourth bolt that extends from the fourth anchor, wherein the first and second anchors are configured for adjusting a distance between the first bolt and the second bolt and the third and fourth anchors are configured for adjusting a distance between the third bolt and the fourth bolt, and wherein the first bolt and the second bolt are spaced apart a predetermined distance from one another, and the third bolt and the fourth bolt are spaced apart a predetermined distance from one another;

wherein, when in use and prior to the first bolt and the second bolt being spaced apart the predetermined distance from one another, a portion of the first bolt is inserted into the first anchor and is free to move radially within the first anchor, the portion of the first bolt being blocked from removal from the first anchor at the second end of the first anchor by the portion of the concrete body.

9. The precast pole foundation in accordance with claim 8, further comprising at least one cavity disposed along said concrete body proximate a midpoint thereof for receiving a conduit.

10. The precast pole foundation in accordance with claim 8, further comprising at least one tee bolt proximate said lower surface of said concrete body.

11. The precast pole foundation in accordance with claim 8, wherein said elongated concrete body comprises a cylinder.

12. The precast pole foundation in accordance with claim 8, wherein said pole comprises at least one of the group: light pole, utility pole, and sign pole.

13. The precast pole foundation in accordance with claim 8, wherein the first anchor, the second anchor, the third anchor, and the fourth anchor are configured to guide the first bolt, the second bolt, the third bolt, and the fourth bolt respectively.

14. The precast pole foundation in accordance with claim 8, wherein at least a portion of said concrete body is reinforced with at least one reinforcing bar embedded therein.

* * * * *